United States Patent [19]

Nogueira

[11] Patent Number: 4,609,443

[45] Date of Patent: Sep. 2, 1986

[54] PROCEDURE FOR THE CATHODIC ELECTROWINNING OF METALS, WITH THE CORRESPONDING ACID GENERATION, FROM ITS SALT SOLUTION

[76] Inventor: Eduardo D. Nogueira, Avda. del Mediterraneo 47, Madrid, Spain

[21] Appl. No.: 751,330

[22] Filed: Jul. 1, 1985

[30] Foreign Application Priority Data

Jul. 2, 1984 [ES] Spain ..... 533.927

[51] Int. Cl.[4] ..... C25B 1/22

[52] U.S. Cl. ..... 204/104; 204/103; 204/105 R; 204/117; 204/129

[58] Field of Search ..... 204/103-104, 204/129, 117, 119, 105 R

[56] References Cited

U.S. PATENT DOCUMENTS 1,952,850 3/1934 Koehler ..... 204/107

3,537,961 11/1970 White et al. ..... 204/107

*Primary Examiner*—R. L. Andrews

[57] ABSTRACT

The present invention relates to cathodic electrowinning of metals involving simultaneous metal winning and acid regeneration in the same electromechanical cell.

8 Claims, 1 Drawing Figure

PROCEDURE FOR THE CATHODIC ELECTROWINNING OF METALS, WITH THE CORRESPONDING ACID GENERATION, FROM ITS SALT SOLUTION

Industrial electrowinning of metals from its salt solutions requires, obviously, the previous leaching operation of getting these soluble salts from the usually insoluble raw materials, oxides and sulphides being the most common ones.

One of the most widely considered procedures for such leaching operation is the acid treatment of the insoluble compounds, forming the salts corresponding to the acid, that will be soluble if the acid is properly choosen.

The corresponding reactions for one of the most commonly used acid, the hydrochloric acid, and the usual form of one divalent metal, Me, will be, Raw Material $$\text{Oxide—OMe} + 2HCl \rightarrow MCl_2 + H_2O$$

$$\text{Sulphide—MeS} + 2HCl \rightarrow MCl_2 + H_2S$$

$$\text{Metal—Me} + 2HCl \rightarrow MeCl_2 + H_2$$

Hydrochloric acid is consumed and soluble $MeCl_2$ is formed in every case, with different byproducts for every type of raw material.

The soluble salt will be electrolyzed later on the process and the chloride ion will be generally recovered as chlorine. One of the setback of this procedure lies in the requirement of dispossing of the produced chlorine, while simultaneously paying for new hydrochloric acid for renewed leaching.

Usually, both requirements are fulfilled by producing the acid with the chlorine and hydrogen, but such solution implies expensive equipment for handling and reacting the chlorine, as well as extra costs for hydrogen.

This is the main reason behind the extend industrial refusal to win metals via acid leaching and chlorine electrowinning.

The purpose of this invention is overcome such difficulty by simultaneous metal winning and acid regeneration in the same electrochemical cell.

BRIEF DESCRIPTION OF THE DRAWING

This objective is accomplished by use of a new concept of metal electrowinning cell, schematized in FIG. 1. Using its application to lead electrowinning, the description of the cell is:

DETAILED DESCRIPTION OF THE DRAWING

Figure 1:
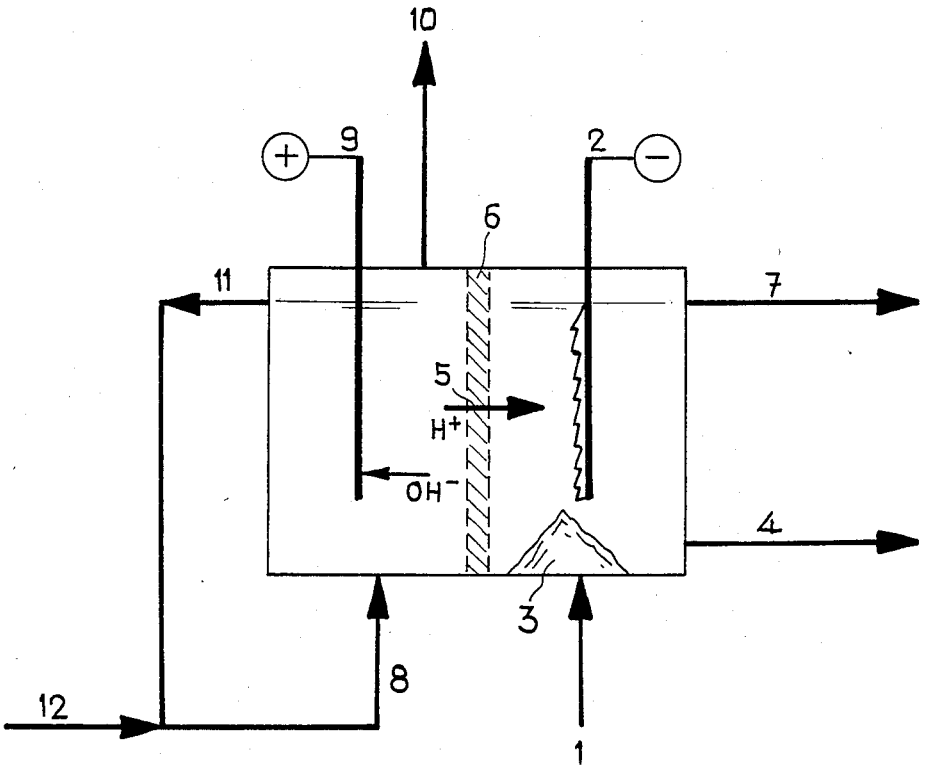

Concentrated lead chloride solution, with low acidity, 1, is fed, as catholyte, into the cathodic space of the cell. There, lead ions are discharged on the cathode, 2, with physical characteristics, such as particle size, depending upon operating conditions.

Usually, sponge lead is formed, and it drops from the cathode to the bottom of the cell, 2, from where it is extracted as a continuous or discontinuous stream, 4.

Electrical equilibrium of cell is restored by protons, 5, coming from the anodic space across the membrane, 6. This membrane, cation permoselective one, separates the electrodic spaces of the cell, and is commercialized now by DUPONT with its trade mark of NAFION.

The catholyte then, with most of its lead content having been replaced with protons, leaves the cell as spent catholyte, 7.

Referred to the incoming catholyte, its lead content has been depressed and its acid content increased. It leaves the cell with renewed leaching potential, and it can be reclaimed to the leaching reactors, where it will use its acid equivalents into getting new metal chlorine content.

The anodic space of the cell must use the electrical current, while producing the excess of protons to be transferred into the catholyte. It is accomplished with a dilute sulphuric acid stream, 8, entering as anolyte. Hydroxyly ions are discharged at the anode, 9, and a gaseous oxygen stream, 10, leaves the cell as anodic product. The anolyte thus becames a concentrated sulphuric acid solution, since it has lost water, through the simultaneous mechanism of hydroxyl discharge and proton migration.

As such concentrated acid, it leaves the cell as spent anolyte 11.

An addition of water, 12, to replace the amount that was electrolyzed, regenerates the anolyte to a quality adequate to be fed to the cell.

This cell, here described in its application to lead electrowinning, can be applied, with minor modifications, to any type of metal process where an acid is required as leachant. It can be applied to any type of leaching acid, not exclusively to the hydrochloric and chloride media. In the same sense, the anodic circuit would be formed by any acid where the electrolysis of water be the prevalent reaction.

EXAMPLE

A cell as schematized in FIG. 1, with cathodic surface of 200 $cm^2$ and Nafion 117 being the membrane separating the electrodic spaces, was operated with a catholyte of lead and sodium chlorides, and an anolyte composed by sulphuric acid in closed circuit. A titanium plate was used as cathode, and a specially activated porous titanium, with an active coating able to withstand acidic medium and oxygen discharge, was used as anode. The anode was supplied by SIGRI.

The operating conditions were:

Temperature: 55° C.

Current density: 1 $KA/m^2$

| Catholyte | Inlet | Outlet |
|---|---|---|
| Pb, g/L | 10,6 | 8,8 |
| NaCl, g/L | 275 | 274 |
| $Cl^-$, g/L | 174 | 170 |
| HCl, g/L | 0,32 | 0,94 |
| pH | 1,6 | 1,04 |

The cell voltage was 2,66 V.

10 liters of a 150 g/L sulphuric acid solution were used as the anodic circuit, and 36 L of catholyte were recirculated during 0,92 h. Values reported for inlet and outlet catholyte correspond with initial and final states of that volumen of catholyte.

A deposit of 62,8 g Pb was obtained, with a current efficiency of 88,7%.

No increase was detected in the lead concentration in the anolyte, confirming that there in no passage of metallic cations to the anodic space.

I claim:

1. Process for the cathodic electrowinning of metals, with corresponding acid generation, comprising the use of an electrochemical cell having anodic and cathodic compartments physically separated by a cation permo-selective membrane, in such a way that different electrolytes are used in each electrodic space, the cathode receiving a solution of the corresponding metallic salt, the metal being discharged at the cathode, and the electrical equilibrium being maintained by protons coming from the anolyte, across the cation permo-selective membrane, there being a change in the catholyte composition from a neutral salt solution into an acidic solution, where the acid and the salt have the same anion; the anode functioning with a different electrolyte comprising a solution of inorganic oxygenated acid, where the applied current discharges oxygen at the anode, thus originating an excess of protons that pass toward the catholyte across the membrane.

2. Process for the cathodic electrowinning of metals, with corresponding acid generation, according to claim 1, wherein the electrolysis of the metallic salt is performed with a metal concentration in the catholyte in the range of 5–50 g/L.

3. Process for the cathodic electrowinning of metals, with corresponding acid generation, according to claim 1, wherein an aqueous solution of sulfuric acid is used as anolyte, with periodic addition of water to compensate the electrolysis of water and its diffusion from anolyte to catholyte, thus keeping constant the acid concentration in a range of 50–200 g/L.

4. Process for cathodic electrowinning of metals, with corresponding acid generation, according to claim 1, wherein the cathodic current density ranges from 0.1 to 10 kiloamps per square meter, depending upon the metal and its desired final deposit form.

5. Process for the cathodic electrowinning of metals, with corresponding acid generation, according to claim 2, wherein an aqueous solution of sulfuric acid is used, as anolyte, with periodic addition of water to compensate the electrolysis of water and its diffusion from anolyte to catholyte, thus keeping constant the acid concentration in a range of 50–200 g/L.

6. Process for cathodic electrowinning of metals, with corresponding acid generation, according to claim 2, wherein the cathodic current density ranges from 0.1 to 10 kiloamps per square meter, depending upon the metal and its desired final deposit form.

7. Process for cathodic electrowinning of metals, with corresponding acid generation, according to claim 3, wherein the cathodic current ranges 0.1 to 10 kiloamps per square meter, depending upon the metal and its desired final deposit form.

8. Process for cathodic electrowinning of metals, with corresponding acid generation, according to claim 5, wherein the cathodic current density ranges from 0.1 to 10 kiloamps per square meter, depending upon the metal and its desired final deposit form.

* * * * *